US008789289B2

(12) United States Patent
Herman et al.

(10) Patent No.: US 8,789,289 B2
(45) Date of Patent: Jul. 29, 2014

(54) METHOD AND AN APPARATUS FOR MANUFACTURING A THREE-DIMENSIONAL SURFACE STRUCTURE WEB

(75) Inventors: Jeffrey Herman, Bala Cynlyod, PA (US); David A. Beck, Appleton, WI (US); Thomas Thoröe Scherb, Sao Paulo (BR)

(73) Assignee: Voith Patent GmbH, Heidenhein (DE)

( * ) Notice: Subject to any disclaimer, the term of this patent is extended or adjusted under 35 U.S.C. 154(b) by 130 days.

(21) Appl. No.: 10/898,637

(22) Filed: Jul. 23, 2004

(65) Prior Publication Data

US 2005/0126031 A1 Jun. 16, 2005

Related U.S. Application Data

(63) Continuation of application No. PCT/US03/02108, filed on Jan. 24, 2003, which is a continuation of application No. 10/056,489, filed on Jan. 24, 2002, now Pat. No. 7,150,110.

(51) Int. Cl.
*F26B 3/00* (2006.01)

(52) U.S. Cl.
USPC ..... 34/453; 34/399; 34/94; 34/454; 162/113

(58) Field of Classification Search
USPC ..... 162/297, 358.1, 363, 364, 113; 34/397, 34/398, 399, 453, 94, 143, 618, 545, 459, 34/454, 114
See application file for complete search history.

(56) References Cited

U.S. PATENT DOCUMENTS

| | | | | | |
|---|---|---|---|---|---|
| 3,301,746 | A | * | 1/1967 | Sisson et al. | 162/113 |
| 3,313,679 | A | | 4/1967 | Hintermaier et al. | 162/199 |
| 4,102,737 | A | * | 7/1978 | Morton | 162/113 |
| 4,309,246 | A | * | 1/1982 | Hulit et al. | 162/113 |
| 4,356,059 | A | | 10/1982 | Hostetler | 162/111 |
| 4,675,079 | A | * | 6/1987 | Webster | 162/360.3 |
| 5,411,636 | A | | 5/1995 | Hermans et al. | |
| 5,492,589 | A | | 2/1996 | Mizuno | 156/280 |
| 5,492,598 | A | | 2/1996 | Hermans et al. | |
| 5,505,818 | A | | 4/1996 | Hermans et al. | |
| 5,510,001 | A | | 4/1996 | Hermans et al. | |
| 5,510,002 | A | | 4/1996 | Hermans et al. | 162/113 |
| 5,701,682 | A | | 12/1997 | Chuang et al. | 34/115 |

(Continued)

FOREIGN PATENT DOCUMENTS

| | | | |
|---|---|---|---|
| DE | 199 46 972 A1 | 4/2001 | F26B 13/24 |
| GB | 2 235 705 | 3/1991 | D04H 3/14 |

(Continued)

OTHER PUBLICATIONS

Canadian Office Action conducted in counterpart Canadian Patent Application No. 2,474,489 (Dec. 17, 2009).

*Primary Examiner* — Kenneth Rinehart
(74) *Attorney, Agent, or Firm* — Greenblum & Bernstein, P.L.C.

(57) ABSTRACT

A method and apparatus for manufacturing a fiber web, in particular a web of tissue or hygiene material, provided with a three-dimensional surface structure, whereby the fiber web is pressed at a dry content of <35% onto an imprinting fabric by way of a first pressure field and is thereby pre-imprinted and the fiber web is guided through at least one other pressure field, and at least one of dewatering and drying the fiber web.

73 Claims, 10 Drawing Sheets

(56) References Cited

U.S. PATENT DOCUMENTS

| | | | | |
|---|---|---|---|---|
| 5,804,036 | A | 9/1998 | Phan et al. | |
| 5,830,316 | A | 11/1998 | Ampulski | |
| 5,843,279 | A | 12/1998 | Phan et al. | |
| 6,051,105 | A | 4/2000 | Ampulski | |
| 6,083,346 | A | 7/2000 | Hermans et al. | 162/115 |
| 6,190,506 | B1 | 2/2001 | Beck | |
| 6,235,160 | B1 * | 5/2001 | Tietz et al. | 162/358.5 |
| 6,419,793 | B1 | 7/2002 | Beck | |
| 6,454,905 | B1 | 9/2002 | Hollmark et al. | 162/206 |
| 6,485,612 | B1 * | 11/2002 | Graf | 162/358.1 |
| 6,514,382 | B1 | 2/2003 | Kakiuchi et al. | 162/109 |
| 6,533,900 | B2 | 3/2003 | Puustinen et al. | 162/286 |
| 6,616,812 | B2 * | 9/2003 | Beck | 162/358.2 |
| 2004/0237210 | A1 | 12/2004 | Thoroe-Scherb et al. | |
| 2007/0289159 | A1 | 12/2007 | Thoroe-Scherb et al. | |

FOREIGN PATENT DOCUMENTS

| | | | |
|---|---|---|---|
| GB | 2 305 156 | 4/1997 | B65G 15/36 |
| WO | WO 99/47749 | 9/1999 | D21F 11/00 |
| WO | WO 01/18307 | 3/2001 | D21F 11/00 |
| WO | 03/000002 | 1/2003 | |

* cited by examiner

METHOD AND AN APPARATUS FOR MANUFACTURING A THREE-DIMENSIONAL SURFACE STRUCTURE WEB

CROSS REFERENCE TO RELATED APPLICATIONS

This is a continuation of PCT application No. PCT/US03/02108, entitled "MANUFACTURING THREE DIMENSIONAL SURFACE STRUCTURE", filed Jan. 24, 2003, which claims priority to U.S. application Ser. No. 10/056,489 filed Jan. 24, 2002, now U.S. Pat. No. 7,150,110, and a continuation of U.S. application Ser. No. 10/056,489 filed Jan. 24, 2002, now U.S. Pat. No. 7,150,110.

BACKGROUND OF THE INVENTION

1. Field of the Invention

The present invention relates to a method and to an apparatus for manufacturing a fiber web, and, more particularly to dewatering of a fiber web wherein the fiber web is a web of tissue or hygiene material, provided with a three-dimensional surface structure.

2. Description of the Related Art

The imprinting of a three-dimensional structure into the surface of a paper web, in particular into the surface of a tissue web, more particularly into the surface of hand tissue, is known (see, for example, WO 99/47749, WO 01/18307). It is further known that a very good paper quality can be achieved by so-called through-air drying (TAD). However, it is disadvantageous that the use of TAD dryers is very complex and correspondingly expensive. What is needed in the art is a method of apparatus for dewatering of a fiber web of tissue or hygiene material, having a three-dimensional surface structure, which is less complex and less expensive.

To make the highest quality tissue and toweling products, it is necessary to develop products that are high in bulk, high in absorbency, yet still have adequate strength. The normal papermaking processes, which includes shoe and roll presses for dewatering a wet sheet, do not provide a bulky, absorbent sheet. Instead, they provide a strong, "flat" sheet that is typical of old technology, low cost tissue.

Several techniques are used to develop sheet bulk. Generally, the fiber web or sheet is first formed on, or vacuumed into, a special embossing or imprinting fabric. This fabric is rough, due to its coarse weave. The wet sheet conforms to this fabric and in doing so this increases the overall bulk of the sheet. Next, air is pulled through the sheet using a vacuum or low pressure. This airflow mechanically dewaters the sheet. Finally, hot air is blown through the sheet to dry it. The hot air dryer is called a Through Air Dryer (TAD for short). A TAD is usually made up of two large drums that by way of a vacuum pull heated air through the sheet, thereby drying it. These are very expensive units costing millions of dollars, to install.

As shown in earlier times, one way to get high bulk is to emboss or mold the sheet while it is wet. This can be done either by forming the sheet on a rough forming or molding fabric, or it can be formed "flat" in a conventional manor and then vacuumed into an embossing fabric. Either way, the sheet surface takes on the approximate shape of the embossing fabric surface. After the sheet is molded, it must be dried to its final state.

Drying is usually a two step process, where water is first removed mechanically, and then the remaining water is removed using heat. The problem is that it is difficult to mechanically remove water from the sheet without destroying its molded structure. If the sheet and fabric are pressed, for example, little water is removed since the embossing fabric adsorbs and then rewets the sheet after pressing. If the sheet is removed from the embossing fabric and then pressed, more water is removed, but the sheet bulk and absorbency is lost since the sheet becomes flatter.

The situation is slightly better if the sheet and embossing fabric are passed over a vacuum box. In this case, most prior art shows that the embossing fabric is on the vacuum side, supporting the sheet as air is pulled through it. The action of the vacuum removes water from the sheet, but after the water leaves the sheet, the embossing fabric retains much of it. Later, when the vacuum is removed, water passes back into the sheet, rewetting it. With this technology, the highest solids obtained for the sheet with low basis weights is less than 25% and more likely close to 20%.

Nevertheless, vacuum dewatering has been used since it retains the sheet structure. However because the sheet is so wet, this technology uses a lot of energy, in the form of a hot air, to dry the sheet.

SUMMARY OF THE INVENTION

The present invention provides an improved method and an improved apparatus for manufacturing a fiber web provided with a three-dimensional surface structure with which a high quality of the end product can be achieved in an economic and correspondingly favorably priced manner even without the use of a larger TAD drying apparatus. A corresponding quality is reached with respect to the water retention capability, the water absorption rate, the bulk, softness, etc.

The present invention provides a method for manufacturing a fiber web, in particular a web of tissue or hygiene material, with a three-dimensional surface structure, in which the fiber web is pressed, e.g. sucked, at a dry content of <35%, preferably <30% and more preferably <25% onto an imprinting fabric by way of a first pressure field, and is thereby pre-imprinted, and is subsequently once more pressed onto an imprinting fabric by way of a further pressure field for further dewatering and drying of the fiber web.

As a result of this embodiment, a lasting three-dimensional surface structure is produced in the relevant fiber web, i.e. in particular in the relevant paper web, tissue web, or hygiene paper web, which is also present in the desired manner in the web even after the drying process. The use of a complex and correspondingly expensive TAD process is no longer required. A lasting surface structure of, for example, a tissue web or a hygiene paper web can now also be produced downstream of the forming region or forming zone even without such a TAD drying apparatus.

Preferably, the fiber web is again pressed onto an imprinting fabric by way of a second pressure field in order to fix strength without destroying the three-dimensional surface structure. The fiber web is preferably guided between the first and the second pressure field through the at least one third pressure filed. Preferably, the same imprinting fabric is used in the first pressure field and the second pressure field.

The imprinting or structured fabric could be a woven or a casted fabric in a continuous loop and can, for example, be a TAD fabric or an imprinting membrane. The fiber web is generally pre-imprinted downstream of the forming region. In certain cases it is advantageous for the fiber web to be formed on the imprinting fabric used for the pre-imprinting. The fiber web can, however, also be transferred onto the imprinting fabric used for the pre-imprinting.

In accordance with a preferred embodiment, at least the first pressure field is produced by way of at least one suction element arranged on the side of the imprinting fabric remote from the fiber web in order to suck or press the fiber web into the surface structure of the imprinting fabric. In this embodiment, a so-called wet suction box or pressure box can be used as the suction or pressure element.

It is also of advantageous for the fiber web to be pressed gently in the further pressure field, i.e. preferably over an extended nip in the web running direction.

The further pressure field is preferably produced by way of a press nip. To effect the most gentle possible pressing of the web, this press nip can, for example, be produced between a dryer cylinder and an opposing element, with the fiber web guided through the press nip being in contact with the surface of the dryer cylinder and contacting the imprinting fabric with its other side. In particular a so-called Yankee cylinder can be used as the dryer cylinder. In particular a shoe press unit, which includes a flexible sleeve guided via a press shoe in the region of the press nip, can be used as an opposing element interacting with the dryer cylinder, with a shoe pressing roll provided with a flexible roll sleeve preferably being used as the shoe press unit. However, a press roll or a suction pressing roll can, for example, also be used as an opposing element interacting with the dryer cylinder.

A preferred practical embodiment of the method in accordance with the present invention is characterized in that the pre-imprinted fiber web is dried on the dryer cylinder, or the Yankee cylinder, the fiber web is creped and/or the fiber web is subsequently wound up.

In accordance with a preferred embodiment of the method in accordance with the present invention, the dry content at which the fiber web is pre-imprinted and/or the dry content at which the three-dimensional surface structure is created is selected in each case at <30%, preferably <25%, in particular <15%, and even more preferably <10%. The water retention capability and the bulk, among other things, are thus lastingly increased, which means that the desired imprinting is also still present on the use of the end product, for example of a relevant web of tissue or hygiene material. In particular the advantage of a higher water retention capability for towel tissue (towel paper) is also still effective on the use of the relevant end product.

The third pressure field is preferably provided between the first pressure field and the second pressure field.

In accordance with a preferred practical embodiment of the method of the invention, a drying apparatus is used in order to provide said third pressure field.

In accordance with a preferred practical embodiment of the method of the invention, a suction or pressure device is used as a drying apparatus. The fiber web can, for example, be guided together with an imprinting fabric both through the third pressure field and the second pressure field. It is of advantageous if the suction or pressure device has a curved surface and if the fiber web and the imprinting fabric are guided over this curved surface. A suction roll can, for example, be used as the suction device. Such a suction device can have a pressurized hood to support the vacuum effect of the suction device.

According to another preferred practical embodiment of a method of the present invention the third pressure field is provided by a gas press, preferably an air press. Such a gas or air press can, for example, include an arrangement of at least four rolls or a U-shaped box. It is advantageous to operate the gas or air press, for displacement dewatering, with a pressure in the chamber of >30 psi and preferably >40 psi.

In general, one or more third pressure fields can be provided. The third pressure fields can, for example, be provided by a drying apparatus of a different kind. For example, one of the drying apparatus can include a gas or air press whereas another drying apparatus may include a suction roll or the like.

Further advantages result from the use of a press shoe due to the relatively long press nip, since a better transfer of the fiber web to the Yankee cylinder is achieved over a longer nip, thereby providing a longer dwell time.

The imprinting fabric can in particular be guided via the suction element or the wet suction box upstream of the suction device, i.e. for example the suction roll, in order to suck the fiber web into the three-dimensional surface structure of the imprinting fabric and thus to imprint this structure onto the imprinting fabric. At the same time, the relevant suction element results in a corresponding increase in the dry content.

It is also advantageous for the length of the press nip of the shoe press including the dryer cylinder and the shoe press unit observed in the web running direction to be selected larger than a value of approximately 80 mm and for the shoe press to be designed such that a pressure profile results over the press nip length with a maximum pressing pressure which is smaller or equal to a value of approximately 2.5 MPa. A gentle pressing is thus ensured with which it is avoided that the structure produced in the fiber web, e.g. in the tissue web or in the hygiene paper web, is again smoothed out.

As already mentioned, a suction roll, with which a pressure hood is preferably associated, can, for example, be used between the suction element producing the first pressure field and the press nip.

In accordance with a preferred practical embodiment of the method in accordance with the present invention, at least one dewatering fabric with zonally different fabric permeability is used in the forming region. This dewatering fabric can be provided as an outer fabric. This embodiment of the method is advantageous in the manufacture of towel tissue. The screen produces a fine structure, which increases the water absorbing rate providing an increased water retention capability in conjunction with the imprinting in accordance with the present invention.

In certain cases, it is advantageous if a former with two circulating dewatering fabrics are used, such as a twin wire former, which run together to form a pulp run in gap and are guided over a forming element such as a forming roll, such as a forming roll, and if a dewatering fabric with zonally different fabric permeability is used as an outer fabric not coming into contact with the forming element and/or as an inner fabric. In this connection, an imprinting fabric can be used as an inner fabric, for example, and preferably a dewatering fabric with zonally different fabric permeability as an outer fabric. It is, for example, also possible for the fiber web preferably to be transferred from the inner fabric to an imprinting fabric.

In wet imprinting in a tissue machine provided with an imprinting fabric, it is in particular a question of achieving the desired dry content. The web can be wet imprinted by way of the imprinting fabric using a suction box upstream of the press. To now avoid the three-dimensional surface structure, which was pre-imprinted by the wet imprinting in the region of the wet suction box, being destroyed again by a short-term high pressure in the press nip, in cooperation with a press felt, as is the case with a conventional suction press roll or press roll, in accordance with an advantageous practical embodiment of the method in accordance with the present invention, there is guided through the press nip an imprinting fabric, e.g. or an imprinting membrane, which is structured such that a smaller a TAD fabric or portion formed of raised or closed zones (solid portions between the holes) results for this imprinting fabric in comparison with the contact portion of recessed zones or holes and accordingly a smaller non contact area portion of the fiber web is pressed in the press nip. The smaller contact area portion of raised or closed zones produces the web regions of high density for the strength, whereas the larger surface portion of recessed zones or holes, which remains at least substantially unpressed, provides the desired water absorption capacity and the desired bulk such as has previously only been achieved by a complex and expensive TAD drying. An imprinting fabric can advantageously be used in which the contact area portion of raised or closed zones is ≤40% and preferably lies in a range from approximately 20% to approximately 30%, and in particular at approximately 25%. The contact area need not be the same as the open area or the void volume. The open area or the void volume of a fabric can be independent of the contact area.

An imprinting fabric is expediently used in which the raised zones and the recessed zones result through offsets, i.e. through intersections of picks and ends, of a fabric cloth. As already mentioned, an imprinting membrane can, for example, also be used in which the raised and recessed zones result through the holes. It is advantageous in this case that 100% of the surface is pressed around the holes and a higher strength results.

The relevant imprinting fabric can again be guided together with the fiber web, for example, over a dryer cylinder, in particular a Yankee cylinder. A shoe-pressing unit can again be used as the opposing element interacting with the dryer cylinder. The length of the press nip observed, in the web running direction, and the pressure profile, resulting over the press nip length, can also be selected as described above.

It has been found that with the method in accordance with the present invention, a water absorbing capability (g $H_2O$/g fibers) higher by 50% and a bulk ($cm^3$/g) higher by 100% can be achieved with the same tensile strength when an imprinting fabric is used instead of a conventional felt in the press nip.

An increased quality of the paper results from the lower pressing of the web as a consequence of the smaller area proportion of raised zones, and not due to a TAD dryer. The permeability of the web results from the stretching of the web into the structure of the imprinting fabric by way of the suction element, whereby so-called pillows are produced, which correspondingly increase the water absorbing capability and the bulk. A relatively complex and correspondingly expensive TAD dryer is therefore no longer necessary for this.

The function of the TAD drum and of the through-air system consists of drying the web and, for this reason, the above mentioned alternate drying apparatus (third pressure field) is preferable, since the third pressure field can be retrofitted to a conventional machine at lower cost than TAD.

To achieve the desired dryness, in accordance with a preferred embodiment of the method of the present invention, at least one felt with a foamed layer wrapping a suction roll is used for dewatering the web. The foam coating can be selected such that mean pores size in a range from approximately 3 μm to approximately 6 μm result. The corresponding capillary action is therefore utilized for dewatering. The felt is provided with a special foam layer, which gives the surface very small pores whose diameters can lie in the range set forth from approximately 3μ to approximately 6 μm. The air permeability of this felt is very low. The natural capillary action is used for dewatering the web while this is in contact with the felt.

In accordance with an advantageous embodiment of the method of the present invention, a so-called SPECTRA membrane is used for dewatering the web, with this SPECTRA membrane preferably being laminated or otherwise attached to an air distribution layer, and with this SPECTRA membrane preferably being used together with a conventional woven fabric. Such a SPECTRA membrane can in particular be designed and manufactured as is described in GB 2 305 156 A in connection with its FIG. 3 and in GB 2 235 705 B, which are incorporated herein by reference.

The SPECTRA membrane can be a membrane with a regular, non-woven mesh structure through which suction is possible. It can be provided with spun reinforcement threads which extend through the mesh structure in the web running direction (see in particular FIG. 3 of GB 2 305 156 A). This SPECTRA membrane can in particular be a porous, reinforced membrane made from a composite, with spun threads or yarns extending in the machine direction forming the reinforcing elements and the surrounding matrix material including fluid passages, completely encapsulating the spun threads and connecting them to one another, spun thread for spun thread, to produce the non-woven SPECTRA membrane (see in particular GB 2 235 705 B). In other respects, the SPECTRA membrane can also be designed and manufactured as is described in GB 2 305 156 A and GB 2 235 705 B. As mentioned above the SPECTRA membrane can be laminated or otherwise attached to an air distribution layer.

Since the SPECTRA membrane has a relatively coarse cast structure, it is an advantage for it to preferably be used together with a conventional, in particular woven, fabric arranged between the SPECTRA membrane and, for example, a through flow cylinder. The distribution of the air flow is thus substantially improved with a more uniform distribution of air/gas is achieved and the drying is thus more uniform. This effect is advantageous when the surface of the through-flow cylinder only has an open area of <25% and large land areas are provided between the holes. Such a SPECTRA membrane can be used instead of the felt with a foamed layer. An anti-rewetting effect is utilized for dewatering instead of the capillary effect.

In accordance with a further advantageous alternative embodiment of the method of the present invention a so-called anti-rewetting membrane or anti-rewetting fabric (or anti-rewet fabric) can also be used for dewatering the web. The anti-rewetting membrane can in particular include the following:

- at least one air distribution fabric layer, with such an air distribution fabric layer being configured for a coming into contact with the fiber web; and
- a perforated film layer, which can consist of a polyester film or of a plastic film, wherein the perforated film layer has a first film side and a second film side and wherein the first film side can be laminated or applied to the relevant air distribution fabric layer. The perforated film layer can also be brought into direct contact with the paper web, while in this case, however, the positive effect being substantially lower. A respective air distribution fabric layer can include a plain weave (linen bond) or a fabric of a plurality of floating threads (multi-float weave, multi-strand bond; weave type). The perforated film layer can include a series of perforation holes, with each set of perforation holes, which are spaced apart as closely as possibly, being separated from the others by a perforation space, with each air distribution fabric layer having an associated kind of material bond or weave and with the kind of material bond or weave having the ability to disperse the air over a distance greater than the perforation space. That means the weave repeat length should be equal to or larger than the perforation space. The bond kind or weave kind interval distance can in particular also be larger than the perforation space. The perforation film layer can have a series of perforation holes, with the perforation film layer being able to have, for example, approximately 40,000 holes per $m^2$. The perforation film layer can in particular have a series of perforation holes, with the perforation film layer being able to have, for example, less than approximately 200,000 holes per $m^2$. The perforation film layer can have an open area, for example, in the range from approximately 1% to approximately 30% and preferably in a range from, for example, approximately 5% to approximately 15%.

The perforated film layer can, for example, have a thickness of less than approximately 0.04 inches, with the thickness, for example, being less than approximately 0.005 inches. Moreover, the anti-rewetting membrane can, for example, include a first air distribution fabric layer and a second air distribution fabric layer, with the first air distribution fabric layer being able to be laminated or applied to the first film side and with the second air distribution fabric layer being able to be laminated or applied to the second film side. A respective air distribution material layer can, for example, be a fabric with a satin weave.

The anti-rewetting membrane can be used together with a conventional, in particular woven, fabric or also without an additional fabric or the like.

The method in accordance with the present invention thus also provides the advantage that substantially higher dry contents of the tissue web are achieved even upstream of the dryer cylinder, in particular the Yankee cylinder, by avoiding the rewetting as a consequence of the embodiment of the method in accordance with the present invention, while retaining the high specific bulk, which is important for tissue. It is of particular advantage if the web is wet imprinted at a low dry content upstream of a dewatering unit or dewatering apparatus.

A pressure difference of the gas between the two sides of the web is absolutely necessary for the wet imprinting. The use of a suction box is particularly advantageous. The use of a pressure bag with compresses air, such as a pressure field one, is also possible.

As already mentioned, the anti-rewetting membrane does not necessarily have to be used together with a conventional, in particular woven, fabric, since such an anti-rewetting membrane also effects a good flow distribution effect.

A clothing, e.g. a fabric, felt with a foamed layer, a SPECTRA membrane—preferably together with a conventional, in particular woven, fabric—or an anti-rewetting membrane with or without a conventional, in particular woven, fabric, can be guided together with an imprinting fabric, such as a TAD fabric or an imprinting machine and a fiber web interposed therebetween around a suction roll, with the clothing preferably being in contact with the suction roll.

The clothing with a foamed layer, SPECTRA membrane, preferably together with a conventional, in particular woven, fabric or an anti-rewetting membrane with or without a conventional, in particular woven, fabric, can, for example, wrap a suction roll with a diameter from, for example, approximately 2 m to 3 m, or a plurality of suction rolls with smaller diameters, preferably two suction rolls each with a diameter of, for example, approximately 2 m. The dwell time of the web in the region of the suction roll or suction rolls should be larger than approximately 0.15 s and less than approximately 0.40 s.

The relevant suction roll can have, for example, a vacuum applied to its lower side or a suction roll with an associated siphon extractor can be used. In particular with a lower diameter, the water can, for example, also be spun into a channel by centrifugal force. The water can in particular also be blown off by way of an air knife.

Dewatering while utilizing the capillary effect is already described in U.S. Pat. No. 5,701,682, but the relevant capillary element is here a part of the suction roll, which is disadvantageous for the conditioning of the capillary element.

The advantage of using a foamed fabric is to have better conditions for cleaning. The run of the fabric is adapted for conditioning. The cleaning device is arranged apart from the suction roll, i.e. apart from the process thereby causing no disturbance.

Despite the utilization of the capillary effect or of the anti-rewetting effect for the dewatering, the suction device can in particular have a pressurized hood to support the underpressure effect of the suction device and to be able to work at higher temperatures (e.g. ~140° C.).

In accordance with a further preferred embodiment of the method in accordance with the present invention, to drive out water by way of gas pressure, such as by an air press, the fiber web is guided together with an imprinting fabric at least once, preferably twice, through a pressure space which is bounded by at least four rolls arranged in parallel and lateral seal plates into which compressed gas is fed. In this connection, the fiber web is preferably guided together with the imprinting fabric between membranes through the pressure space, with preferably an air distribution membrane and an anti-rewetting membrane being used. The basic principle of such a displacement press in which the water in the fiber web is displaced by air, is described, for example, in DE 19946972.

As already mentioned above, the displacement press can alternatively include a U-shaped box.

A method in accordance with the invention for manufacturing a fiber web, in particular a web for tissue or hygiene material, which can be used alone or in combination with one or more of the above described methods, is characterized in that water is driven out of the fiber web by way of a displacement dewatering process. A clothing arrangement is used, which includes, as regarded in the direction of the displacement fluid flow, the following elements: a membrane, an imprinting fabric, the fiber web, and an anti-rewet fabric; and in which the clothing arrangement is, in the direction of the displacement fluid flow, followed by an open surface of a counter device. Suction devices can be associated with the counter devices. The counter device can, for example, include a vented roll, an open box, i.e. a box with a slotted or drilled cover, or the like.

A fabric can be associated with the open surface of the counter device in order to provide a fluid distribution effect. The anti-rewet fabric can, for example, include at least one fluid or air distribution fabric layer, with the distribution fabric layer being configured for contacting the open surface of the counter device.

A method in accordance with the present invention for dewatering a fiber web, in particular a web of tissue or hygiene material, is characterized in that to drive out water by way of gas pressure, e.g. by using an air press, the fiber web is guided together with an imprinting fabric at least once, and possibly twice, through a pressure space which is bounded by at least four rolls arranged in parallel and into which a compressed gas is fed, and in that the fiber web is guided together with the imprinting fabric between membranes through the pressure space, with preferably an air distribution membrane and an anti-rewetting membrane being used. As mentioned above, also a U-shaped box can be used.

An apparatus in accordance with the present invention for manufacturing a fiber web, in particular a web of tissue or hygiene material, is provided with a three-dimensional surface structure characterized in that the fiber web is pressed at a dry content of <35%, in particular <30%, and preferably <25% onto an imprinting fabric, e.g. by suction, by way of a first printing field and is thereby pre-imprinted, and in which the fiber web is guided through at least one pressure field (third pressure field) provided for dewatering and/or drying the fiber web. Preferably, the fiber web is once more pressed onto an imprinting fabric by way of a further pressure field (second pressure field) in order to fix the web strength without destroying the three-dimensional surface structure. The fiber web is preferably guided between the first pressure field (I) and the second pressure field (II) through the at least one third pressure field (III). Preferably, the same imprinting fabric is used in the first pressure field (I) and in the second pressure field (II).

An apparatus in accordance with the invention for manufacturing a fiber web, in particular a web or tissue of hygiene material, is characterized in that it includes a displacement dewatering device for driving water out of the fiber web and a clothing arrangement including, as regarded in the direction of the displacement fluid flow, the following elements: a membrane, an imprinting fabric, the fiber web, and an anti-rewet fabric. Preferably, the clothing arrangement is followed, in the direction of the displacement fluid flow, by a vented roll with an open surface.

An apparatus in accordance with the present invention for dewatering a fiber web, in particular a web of tissue or hygiene material, is characterized in that, to drive out water by way of gas pressure, the fiber web is guided together with an imprinting fabric at least once, and preferably twice, through a pressure space, which is bounded by at least four rolls arranged in parallel and into which a compressed gas can be fed, and in that the fiber web is guided together with the imprinting fabric and between membranes through the pressure space, with preferably an air distribution membrane and an anti-rewetting membrane being used.

According to another embodiment of the present invention, a corresponding clothing arrangement can include, as regarded in the direction of the displacement fluid flow, the following elements: a membrane, an imprinting or embossing fabric, the fiber web or sheet, and an anti-rewet fabric. Consequently, the following fabric order could; for example, be used: membrane/molding/sheet/anti-rewet layer. Such a fabric order can in general be applied to vacuum assisted displacement dewatering (i.e. use of membrane/molding/sheet/anti-rewet fabric/vacuum box or the like). The mentioned fabric order can, for example, be applied to displacement presses of different types. For example, a corresponding displacement press can include a U-shaped box and/or a cluster of four or more rolls. Specifically a tandem (two or more displacement presses) or the like can be provided. An embossing or imprinting fabric is not in any case necessary.

A non-molding transfer fabric can be used or the membrane or the anti-rewet layer could be a transfer fabric. Such an embodiment, without an imprinting fabric, is not specific to tissue alone. Another aspect of the invention is the use of a membrane used to mold or not mold (for graphic paper) a sheet, with an anti-rewet fabric under the sheet.

The membrane according to the present invention reduces air flow, makes it possible to build pressure, reduce process air cost, presses in embossing or imprinting fabric, prevents blowing off the paper web from the imprinting fabric (reduced air flow) and makes it possible to generate further mechanical pressure, which causes high strength areas in the sheet.

The embossing or imprinting fabric carries the sheet or fiber web through the process. The imprinting fabric needs a pattern, surface energy, open area and/or surface texture that holds the sheet without letting the sheet transfer to the anti-rewet layer. It further concentrates membrane pressure into specific areas. The structure of the imprinting fabric causes a pressure pattern that rates high strength areas in the sheet. The unpressed areas give bulk to the sheet despite the pressing. Most of the sheet is not pressed. The imprinting fabric can balance sheet strength with sheet absorbency depending on the imprinting fabric structure. The imprinting fabric releases its water into the sheet thus it has no water to rewet the sheet. The imprinting fabric can carry the sheet through the drying process. If this is done, drying takes less energy than current TAD technology since the imprinting fabric and sheet are at a much dryer level. For lowest air consumption, the imprinting fabric mainly allows vertical flow of air.

The anti-rewet fabric prevents rewet of the sheet. The airflow from the displacement process isolates the water. The anti-rewet fabric does not pick up the sheet from the imprinting fabric. It protects the sheet from process water after the displacement or gas press.

The present invention provides a new process that has many of the advantages of the known processes, without some of the disadvantages. This invention creates a sheet with high bulk, but does it using less energy and small, simpler equipment. More importantly, it can be added as a rebuild to an existing "Yankee" tissue machine making flat sheets. Furthermore, it can reduce energy consumption.

The present invention can be used in particular with crescent formers, duo formers, C wrap formers, S wrap formers and in the manufacture of single layer, multi-layer and multiply tissue.

An advantage of the present invention is a three-dimensional surface structure in the relevant fiber web is present in the web even after the drying process.

Another advantage is the use of a complex and correspondingly expensive TAD process is no longer required.

Yet another advantage is a lasting surface structure can also be produced downstream of the forming region or forming zone even without such a TAD drying apparatus.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
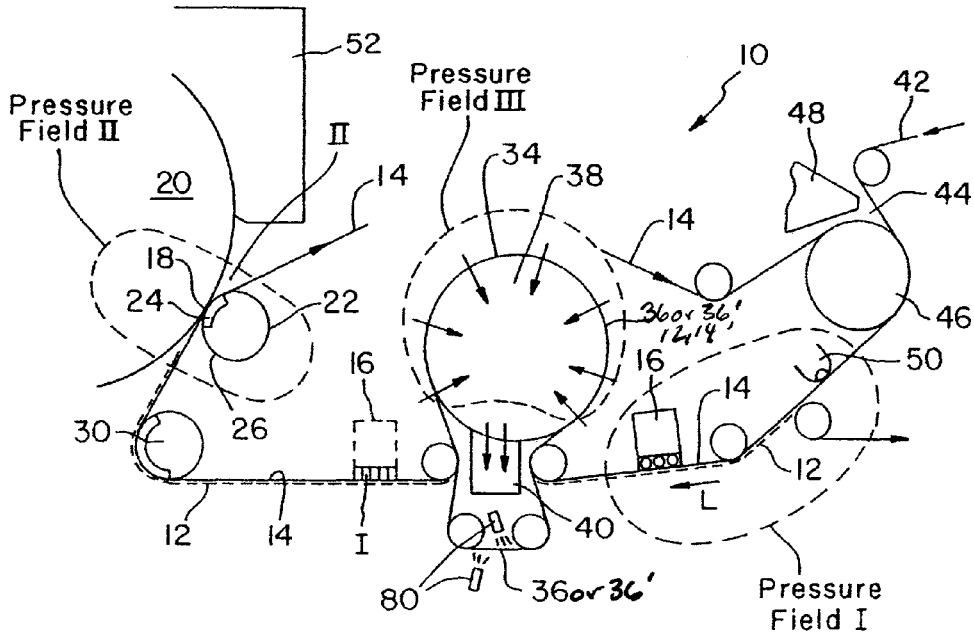
FIG. 1 is a schematic representation of an embodiment of the present invention in the form of an apparatus for manufacturing a fiber web provided with a three-dimensional surface structure in which a dewatering apparatus (third pressure field) is additionally provided in which the capillary action of a felt with a foamed layer, the action of a SPECTRA membrane, preferably with an associated conventional, in particular woven, fabric, or the action of an anti-rewetting membrane with or without a conventional woven, fabric is utilized for dewatering.

Referring now to the drawings, and more particularly to FIG. 1, there is shown an embodiment of apparatus 10 of the present invention for manufacturing fiber web 12 provided with a three-dimensional surface structure in which dewatering apparatus 34, defining a third pressure field is provided in which, for example, the capillary action of a felt 36 with a foamed layer, is utilized for dewatering. In this connection, the foam layer can in particular be selected such that the mean pore size results in a range from approximately 3 μm to approximately 6 μm. A conditioning device 80, also known as a cleaning device 80 includes water shower nozzles or air nozzles. One of the advantages of a foamed fabric is that it is easily accessible for cleaning purposes. That is, the fabric can be cleaned from the outside, from the inside or from both sides. As cleaning devices, suction devices, such as, pipe suction devices are used, alone or in combination with water shower nozzles and/or air nozzles. Instead of a felt with a foamed layer, a so-called SPECTRA membrane 36' is used, with the SPECTRA membrane 36' preferably being used together with a conventional, in particular a woven, fabric. Alternatively, a so-called anti-rewet membrane can also be used. Such an anti-rewetting membrane can be used together with a conventional, in particular woven, fabric or without such an additional fabric or the like.

Felt 36 with foamed layer is guided together with imprinting fabric 14 and fiber web 12 interposed therebetween about a large suction roll 38, with felt 36 preferably being in contact with suction roll 38. Suction roll 38 wrapped, for example, by felt 36 with a foamed layer can, for example, have a diameter from approximately 2 m to approximately 3 m. Suction roll 38 can have a vacuum 40 applied to its lower side. Generally, a siphon extractor can also be associated with suction roll 38, or a tray 40 can be used to take off the water and/or air, which can be blown out of the mantle of the roll.

In the forming region, at least one dewatering fabric with zonally different fabric permeability can be provided.

A former with two peripheral dewatering fabrics 14 and 42, are provided, with inner fabric 14 simultaneously serving as the imprinting fabric. The two dewatering fabrics 14 and 42 run together while forming a pulp run-in gap and are guided over forming element 46 such as in particular a forming roll.

Imprinting fabric 14 is used as the inner fabric of the former which comes into contact with forming element 46. Outer fabric 42 which does not come into contact with forming element 46 can in particular be provided as a dewatering screen with zonally different screen permeability.

The fiber suspension is introduced into the pulp run-in gap 44 by way of a head box 48. a Pick-up or separation element 50, can be configured such that it acts as part of pressure field I, is provided downstream of forming element 46 and the web is held on imprinting fabric 14 by this during separation from dewatering fabric 42. Suction element 16 (solid representation) as the other part of pressure field I is preferably provided upstream of dewatering apparatus 34 with capillary action or, for example, with the action of SPECTRA membrane or an anti-rewetting membrane with or without an additional conventional screen and fiber web 12 is sucked into the 3-dimensional structure of imprinting fabric 14 by this. Suction element 16 can, however, also be arranged between dewatering apparatus 34 with, for example, capillary action, etc. and suction device 30 or suction roll 30, (broken line 16') to present web 12 from separating from imprinting fabric 14.

Fiber web 12 and imprinting fabric 14 are guided through press nip 18 formed between dryer cylinder 20 and shoe press unit 22. Shoe press unit 22 includes flexible band 26, guided over press shoe 24 in the region of press nip 18. Imprinting fabric 14 and fiber web 12 are guided upstream of press nip 18 about suction device 30, which can in particular be a suction roll. Dryer cylinder 20 can in particular be a Yankee cylinder. In this connection, dryer hood 52 can be associated with dryer cylinder 20.

The dry content of fiber web 12 upstream of dewatering apparatus 34 amounts to approximately 10% to approximately 25%; in the region downstream of dewatering apparatus 34, for example, approximately 30% to approximately 40%.

Fiber web 12 is therefore in particular pressed, e.g. sucked, at a dry content of <30% preferably <25%, in particular <15% and more preferably <10%, onto imprinting fabric 14 or structured fabric by way of first pressure field I in the region of suction element 16 and/or in the region of separation element 50 and is thereby pre-imprinted, in particular, and is subsequently once more pressed onto imprinting fabric 14 by way of a further pressure field II in the region of press nip in order to fix and/or increase the strength without destroying the three-dimensional structure of the sheet and for the transfer to the drying cylinder.

Figure 1A:
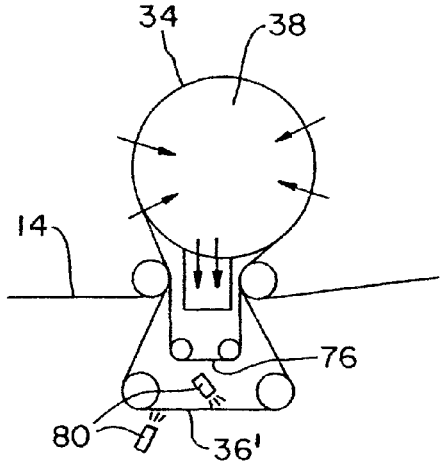
FIG. 1*a* is a schematic representation of the dewatering apparatus of FIG. 1, with a SPECTRA membrane or an anti-rewetting membrane, optionally with an additional conventional fabric.

FIG. 1*a* shows a schematic representation of dewatering apparatus 34 with SPECTRA membrane 36', which is used in the present example together with a conventional, in particular woven, screen 76. In this FIG. 1*a*, a vacuum producing apparatus such as in particular through-air fabric or large suction roll 38 and the imprinting fabric or imprinting fabric 14 can also again be recognized.

Figure 2:
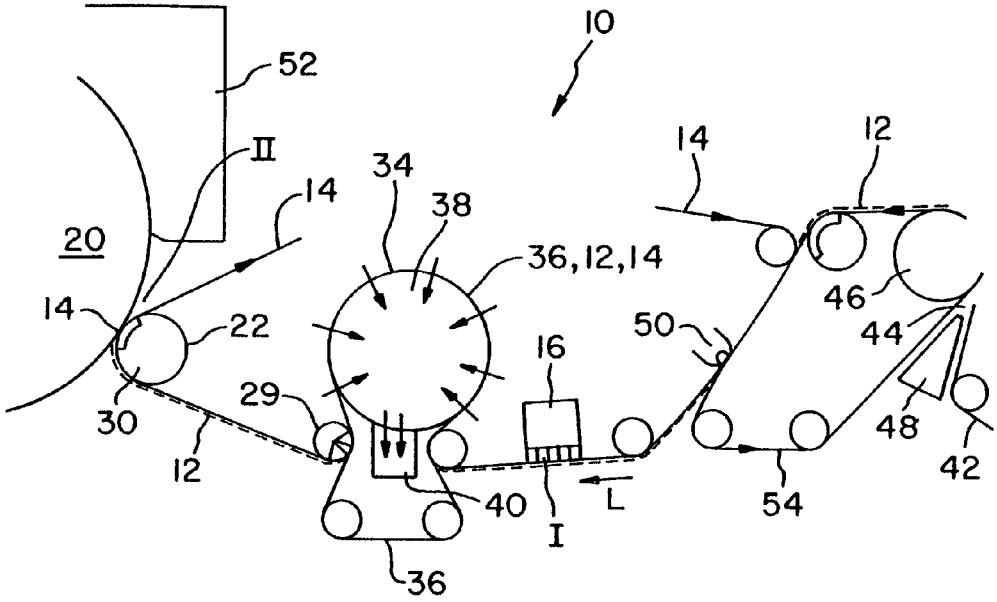
FIG. 2 is a schematic representation of another embodiment of an apparatus for manufacturing a fiber web provided with a three-dimensional surface structure in which a dewatering apparatus is additionally provided in which the capillary action of a felt with a foamed layer, the action of a SPECTRA membrane, with an associated conventional, woven fabric, or the action of a anti-rewetting membrane with or without a conventional, woven fabric is utilized for dewatering.

The embodiment shown in FIG. 2 initially differs from the embodiment of FIG. 1 in that fiber web 12 is taken over by imprinting fabric 14 from an inner fabric 54, of the former. Inner fabric 54 or outer fabric 42 of the former can again be provided as a dewatering fabric with zonally different fabric permeability. The two peripheral dewatering fabrics 42 and 54 again run together while forming a pulp run-in gap 44, with them again being guided via forming element 46 such as in particular a solid or suction forming roll. The pulp run-in gap 44 is again charged with fiber suspension by way of head box 48. In contrast to the embodiment in accordance with FIG. 1, the fiber suspension is, however, supplied from below.

Pick-up element 50, separation element 50, is provided within the loop of imprinting fabric 14 and fiber web 12 is held on imprinting fabric 14 by this on the separation from inner fabric 54 of the former.

Suction element 16 provided within the loop of imprinting fabric 14 is arranged upstream of dewatering apparatus 34 with a capillary action or, for example, of the action of a SPECTRA membrane or of an anti-rewetting membrane with or without an additional, conventional fabric, with generally, however, an arrangement downstream of apparatus 34 also being possible.

The dry content of the fiber web in the present example amounts to between approximately 10% and 25% in the region of pick-up element 50, between approximately 15% and 30% in the region upstream of dewatering apparatus 34 and between approximately 35% and 45% in the region downstream of this apparatus 34. In this case, a pressing roll 28 can be provided instead of a shoe press unit. The pressing roll can also be a suction roll.

The turning roll 29 provided adjacent to the dewatering apparatus 34 can also be a suction roll for a better web transfer.

Figure 2A:
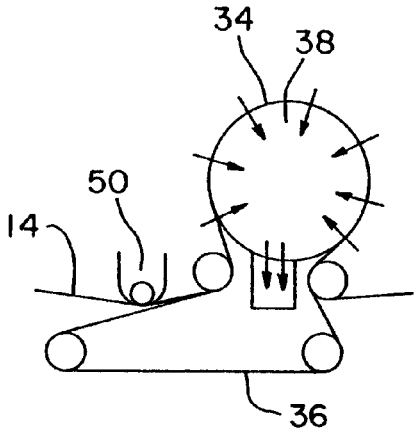
FIG. 2*a* is a variant of the dewatering apparatus of FIG. 2, with a pick-up or separation element for a better web transfer.

Another variant with a pick-up element or a separation element for a better web transfer is shown in FIG. 2*a*.

In another respect, this embodiment can have at least substantially the same design as that in accordance with FIG. 1. Elements corresponding to one another are assigned the same reference numerals.

Figure 3:
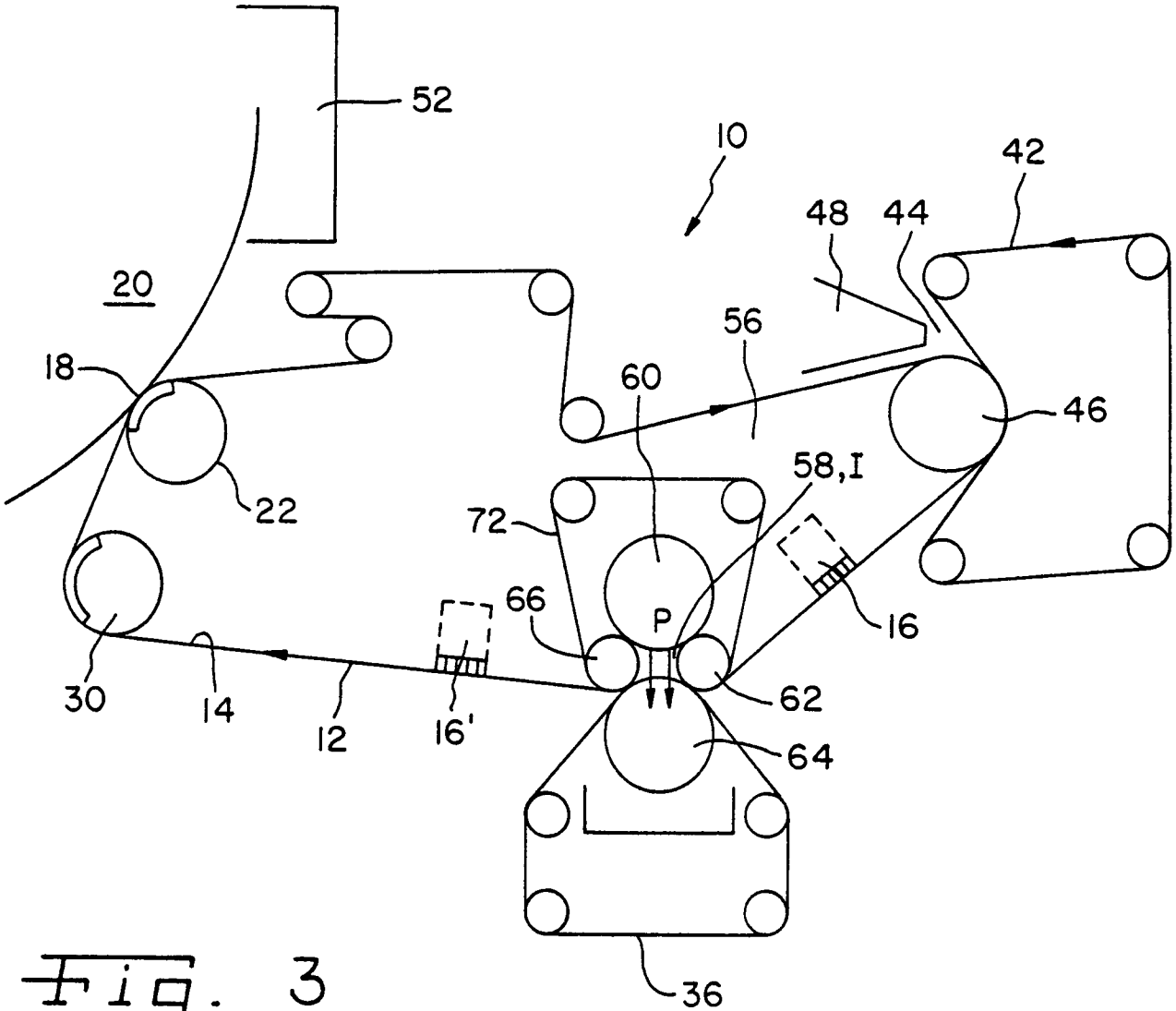
FIG. 3 is illustrated a schematic representation of an embodiment of an apparatus for manufacturing a fiber web provided with a three-dimensional surface structure in which a displacement press is additionally provided.

FIG. 3 shows in a schematic representation an embodiment of apparatus 10 in which a displacement press 56 (pressure field III) is provided. In this connection, to drive out water by way of gas pressure, fiber web 12 is guided together with imprinting fabric 14 at least once through a pressure space 58, which is bounded by at least four rolls 60-66 arranged in parallel and into which compressed gas can be fed. Consequently, the embodiment of FIG. 3 differs from that of FIGS. 1 and 2 in that such a roll arrangement 60-66 defining pressure space 58 is used. In this connection, the fiber web 12 is preferably guided through the pressure space 58 together with imprinting fabric 14 and membrane 72 for air distribution as well as an anti-rewetting membrane 36. The fiber web is sandwiched between imprinting fabric 14 and the anti-rewetting membrane.

Imprinting fabric 14 could be a SPECTRA membrane in which case all the air is forced vertically through the sheet, because it is a cast structure without cross over points. Cross flows in between the membrane and therefore air leakage in the machine direction is eliminated. Imprinting fabric 14 forms the inner fabric of the former, which in turn includes a forming element 46, such as, a forming roll in whose region the inner fabric is provided as imprinting fabric 14 and the outer fabric 42 run together while forming a pulp run-in gap 44, which is charged with fiber suspension by way of a head box 48.

Subsequent to air press 56, the fiber web 12 is again guided with imprinting fabric 14 over a suction device 30, in particular a suction roll, and through press nip 18 (pressure field II) formed between a dryer cylinder 20; in particular a Yankee cylinder, and a shoe press unit 22. In the example shown, a dryer hood 52 is again associated with dryer cylinder 20 or Yankee cylinder 20.

In the present case, the first pressure field I, through which fiber web 12 is pressed onto imprinting belt 14 and correspondingly pre-imprinted at a dry content of in particular <30%, in particular <25%, in particular <15%, and preferably <10%, can be produced by suction element 16.

Figure 4:
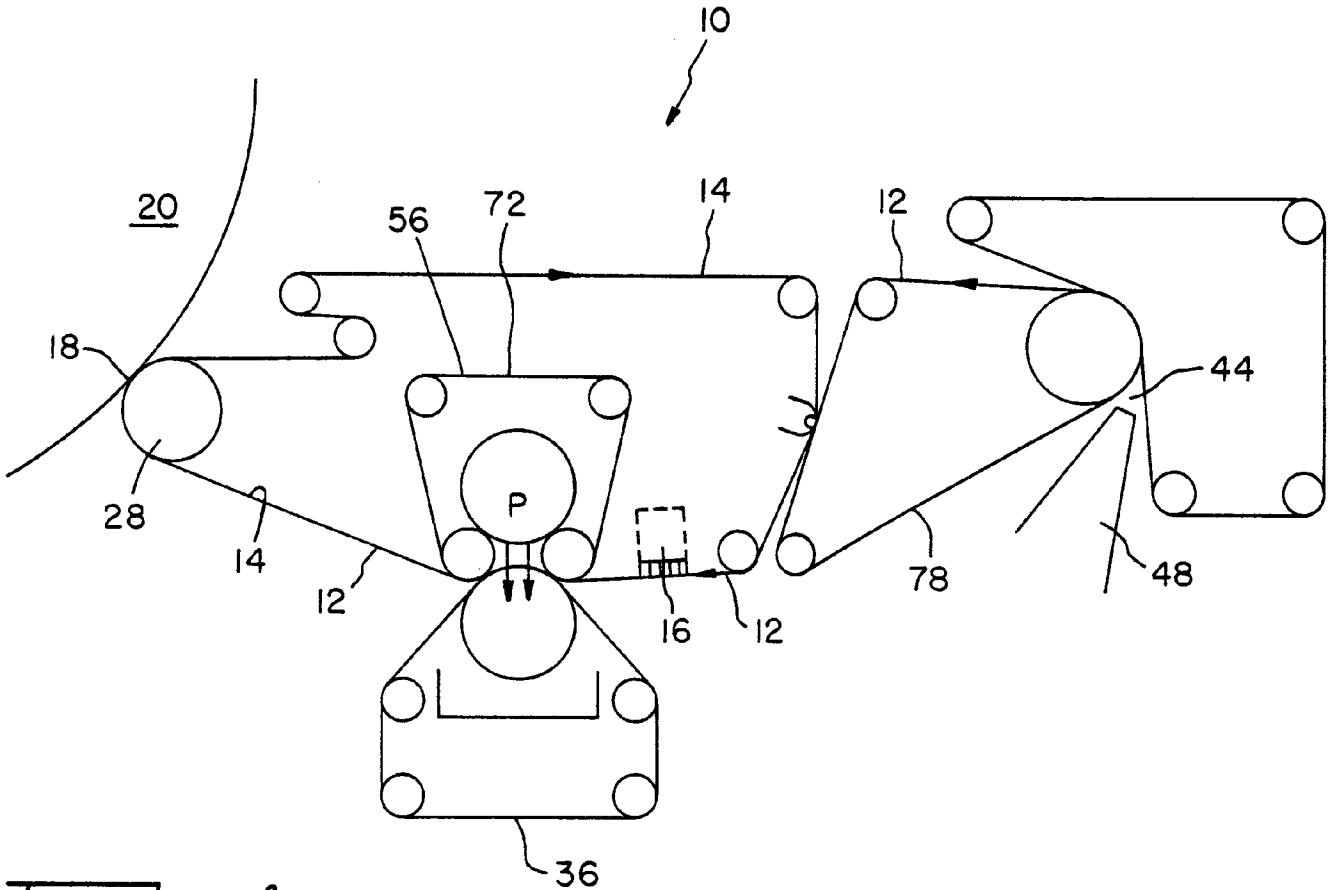
FIG. 4 is a schematic representation of a further embodiment of a papermaking machine with a displacement press.

FIG. 4 shows in a schematic representation a further embodiment with a displacement or air press 56. This embodiment initially differs from that of FIG. 3 in that inner fabric 78 of the former is provided separately from imprinting fabric 14 and fiber web 12 is transferred to imprinting fabric 14 from the inner fabric 78. Moreover, the fiber suspension is poured into pulp run-in gap 44 diagonally from the bottom to the top by way of head box 48.

Suction device 30, provided in the embodiment in accordance with FIG. 3 is omitted. Instead of shoe press unit 22, a conventional press roll 28, solid or suction roll, is provided, which forms press nip 18 with the dryer cylinder 20, in particular the Yankee cylinder 20.

Membrane 72 can, for example, be a fine membrane for air distribution and membrane 36 can, for example, be a laminated coarse cast structure SPECTRA membrane and/or an anti-rewetting membrane. In another respect, the embodiment shown in FIG. 4 can again have at least substantially the same design as that in FIG. 3.

Figure 5:
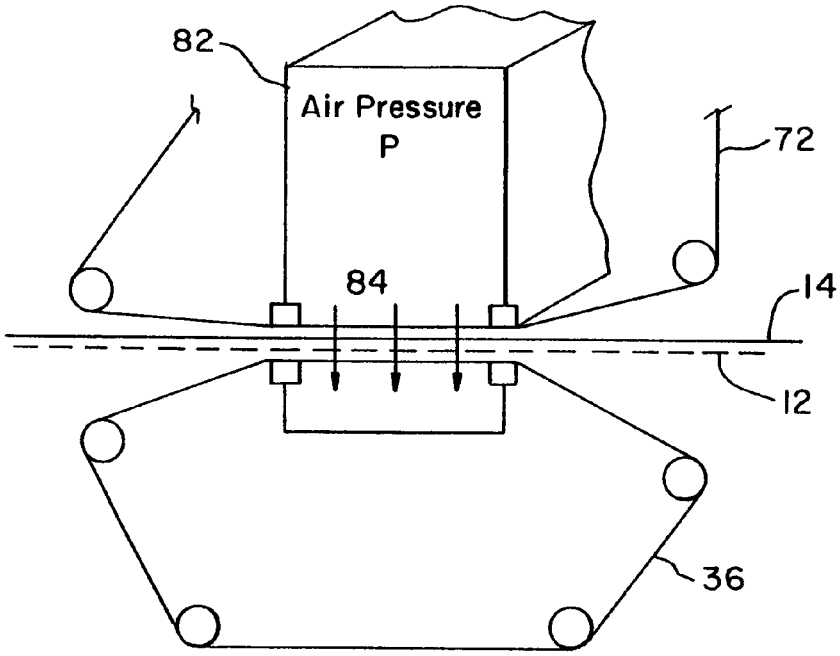
FIG. 5 is a schematic part representation of a further embodiment of the present invention with a displacement press.

FIG. 5 shows in a schematic representation a further embodiment of the apparatus with a displacement press 56.

Displacement press 56 includes a U-shaped box 82. The air pressure within U-shaped box 82 provides an airflow 84 through membrane 72, preferably an air distribution membrane 73 the imprinting fabric 14, fiber web 12 and membrane 36, as regarded in the direction of airflow 84. Membrane 36 can, for example, be a SPECTRA membrane or an anti-rewetting membrane.

Figure 6:
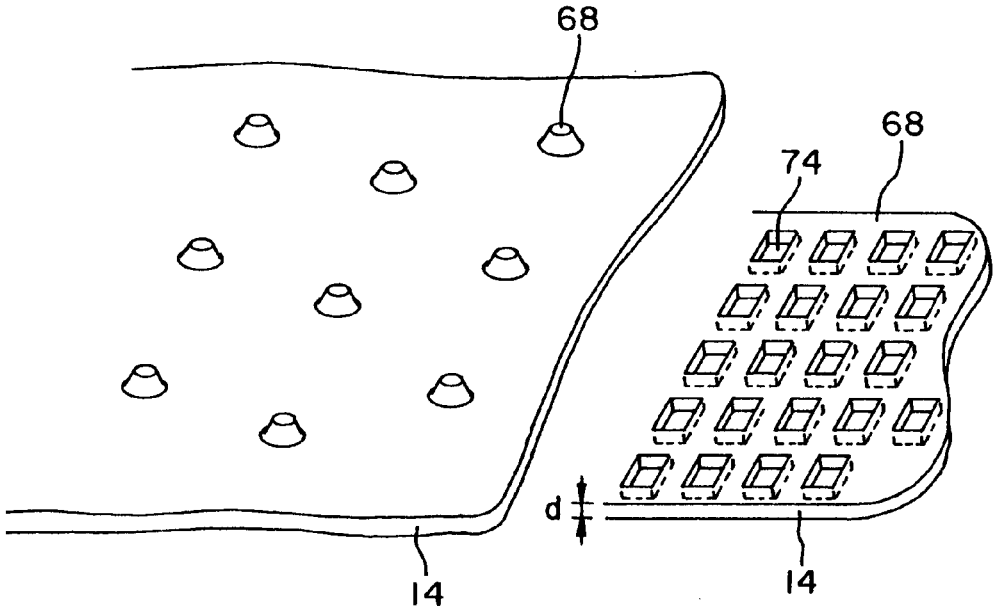
FIG. 6 is a schematic representation of an imprinting fabric with a smaller area portion of raised zones in comparison with the area portion of recessed zones.
Figure 7:
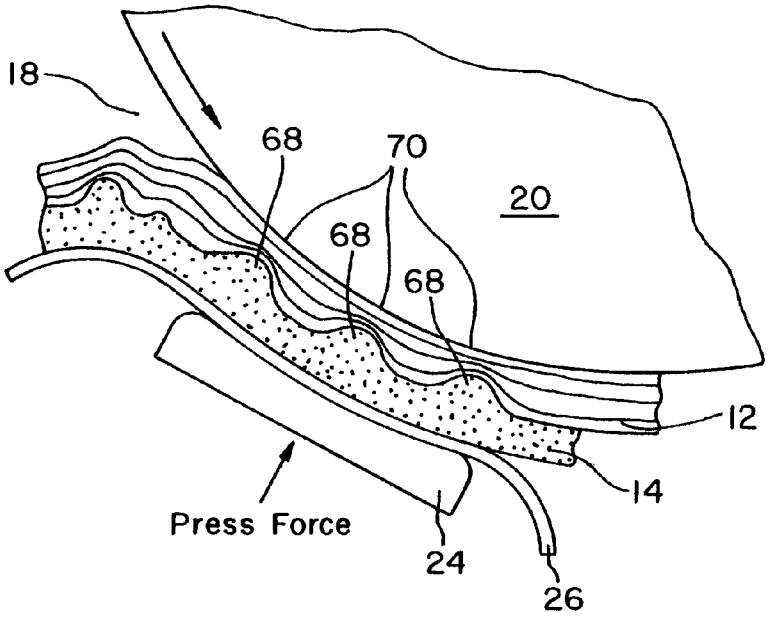
FIG. 7 is a schematic section through a press nip through which the imprinting fabric shown in FIG. 5 is fed, together with the fiber web.

As can be recognized, for example, with reference to FIGS. 6 and 7, respective imprinting fabric 14, e.g. a woven fabric with raised Knuckles (cf. in particular the left hand part of FIG. 6) or imprinting membrane (cf. in particular the right hand part of FIG. 6), guided through press nip 18 can be structured such that imprinting fabric 14 has a smaller area portion of raised or closed zones 68 in comparison with the area portion of recessed zones or holes 74 and accordingly a smaller area proportion of fiber web 12 is pressed in press nip 18.

In this connection, the contact area portion of raised or closed zones 68 can in particular be 40% and can preferably lie in a range from approximately 20% to approximately 30% and in particular approximately 25%. The contact area need not be the same as the open area or the void volume. The open area or the void volume of a fabric can be independent of the contact area.

Raised zones 68 and the recessed zones can result, for example, due to offsets, i.e. due to intersection points of picks and ends, of a woven fabric. In the case of the pressing membrane reproduced in the right hand part of FIG. 6, a corresponding structure arises due to holes 74.

FIG. 6 shows a schematic representation of imprinting fabric 14, e.g., imprinting fabric or imprinting membrane, with a smaller area proportion of raised or closed zones 68 in comparison with an area of recessed zones or holes 74.

The thickness d of the imprinting membrane, shown in the right hand part of FIG. 6, can amount to for example, approximately to 1 mm to approximately 3 mm. The membrane expediently consists of a material resistant to the fiber chemistry. It can consist, for example, of polyurethane.

FIG. 7 shows a schematic cross section through press nip 18, through which imprinting fabric 14, shown in FIG. 5, is guided together with fiber web 12. In this connection, imprinting fabric 14 is in contact with flexible sleeve 26 of the shoe press unit, which is guided in the region of press nip 18 over press shoe 24, by which the desired pressing force can be applied. Fiber web 12 contacts dryer cylinder 20, preferably a Yankee cylinder 20. Moreover, in FIG. 7, pressing zones 70 resulting as a consequence of raised zones 68 can be recognized.

Fiber web 12 is already imprinted upstream of the nip. As can be recognized with reference to FIG. 7, it already contacts the imprinting fabric upstream of the nip.

Figure 8:
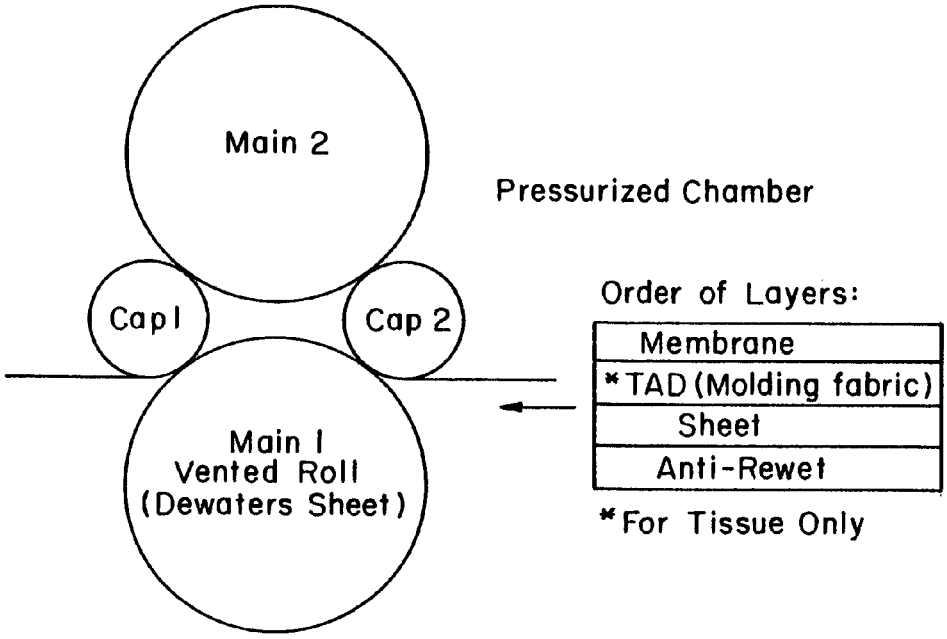
FIGS. 8 to 15 are graphs illustrating advantages of some of the aspects of the present invention.

Some of the above mentioned aspects of the present invention are exemplified in more detail in the following: The applicant has developed a new mechanical process for dewatering paper using high pressure air. Prior to these developments, no continuous method was available for pressing a sheet of paper using the pressures which can now be developed. One of the presses which can, e.g., be used as an air press is called a BCP (Beck Cluster Press). Its preferred state is shown in FIG. 8. The center of the 4 roll cluster along with roll ends seals form "a chamber" that can be pressurized. The web passes through the nips into the pressure chamber. While in the chamber, the web feels a pressure gradient between the chamber and the vented main roll. Because of this gradient, air flows from the chamber, through the web and into the vented main roll. The motion of the air through the web, and the pressure of the chamber, dewaters the sheet. The extent of sheet dewatering depends on the web make up and pressing conditions such as pressure, speed, and temperature.

Good sheet dewatering occurs when the sheet is mechanically pressed and at the same time, air is passed through the sheet. This process is called "displacement dewatering". A "membrane" fabric can be used as the upper most layer in the web. The membrane reduces airflow to the level needed for dewatering, and at the same time, acts like a piston, to convert air pressure into mechanical pressure. Thus, the membrane acts to press and to control airflow through the rest of the web and sheet.

After the membrane layer, the following layers can be varied to influence pressing conditions. For example, consider the web passing through the BCP displacement press as constructed in the layers indicated: High Pressure air Membrane Sheet, Imprinting fabric, Support fabric, Vented roll. For projected commercial displacement pressing conditions, using this configuration the sheet will have solids exiting the BCP in the range of 20% for a 20-30 GSM tissue sheet. With this solids content, there is no advantage of the displacement pressing method over conventional pressing methods. The sheet is simply too wet.

Figure 9:
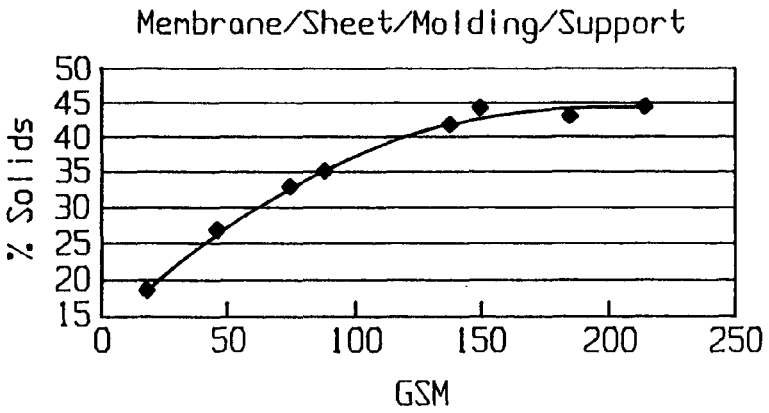

If, however, the basis weight of the sheet is increased with this web configuration, as shown in FIG. 9, the sheet solids increase. This means the displacement pressing process is capable of high solids, but at low sheet basis weight the sheet solids will be very low, due to the sheet reabsorbing water after pressing (cf. FIG. 9).

Figure 10:
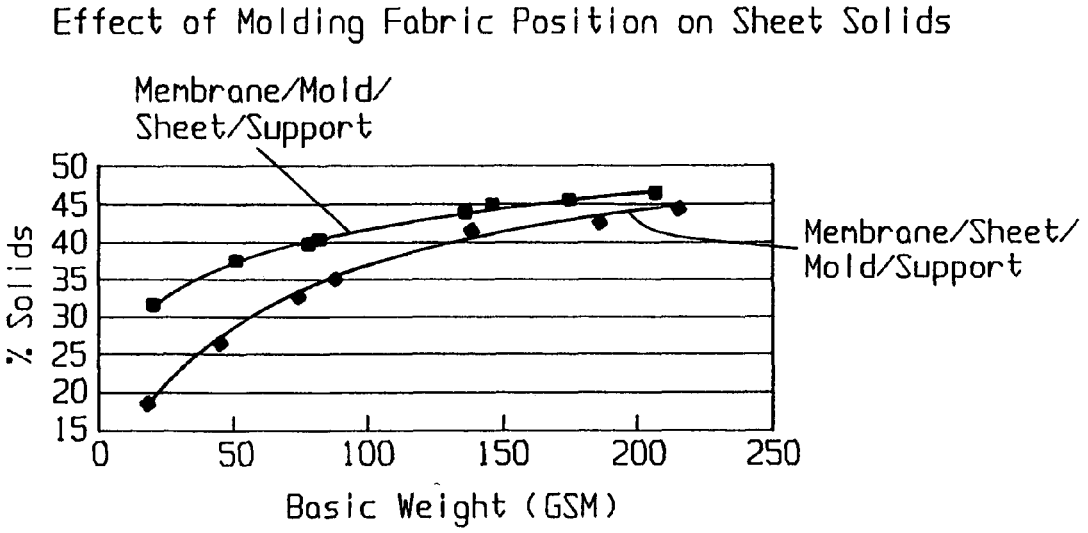

According to one embodiment of the present invention the imprinting fabric is put on the high pressure side, next to the membrane. The web configuration is changed to: High Pressure Air Membrane, Imprinting fabric, Sheet Support fabric, Vented roll (low pressure). This configuration indeed, did increase sheet solids for the tissue sheets. Sheet solids increased from under 20% to about 32% for the 22 GSM tissue sheet. Again, interestingly, increasing sheet basis weight causes increases in solids content (cf. FIG. 10).

Figure 11:
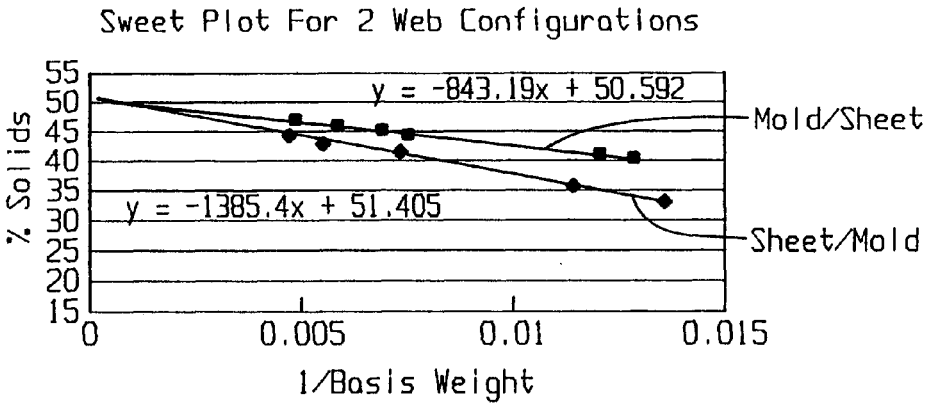

FIG. 11 shows a "Sweet" plot for the two web configurations. The Sweet plot is a way of estimating the amount of rewet in such cases. To make a Sweet plot, one plots 1/(Sheet Basis Weight) on the x axis against sheet dryness on the y axis. The Y intercept from such a plot indicates the theoretical maximum solids attainable if no rewet existed.

This Sweet plot shows that both web conditions would yield solids of about 51% if there were no rewet present. By moving the embossing fabric on top of the sheet, there is greatly increased sheet solids for low basis weight tissue, but the Sweet plot shows that the 32% tissue solids is a long way from the maximum solids of 51% attainable for conditions.

Figure 12:
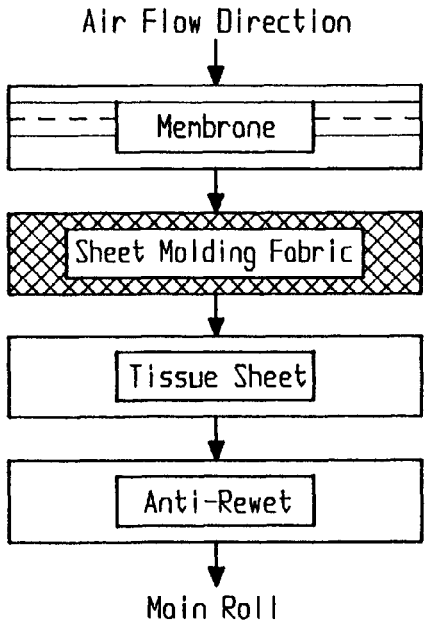
Figure 13:
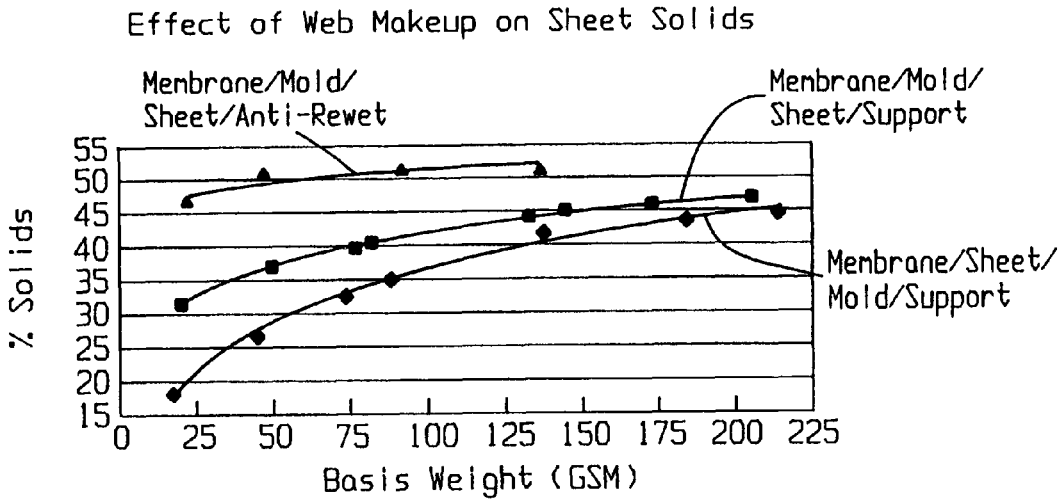

Additional research led the applicant to develop an anti-rewet fabric that virtually eliminates sheet rewet. This fabric, placed underneath the sheet (cf. FIG. 12), vastly inhibits water from passing back into the sheet after displacement pressing. By putting the anti-rewet fabric under the tissue sheet, a gain in sheet dryness was seen. The improvement in solids are as shown in FIG. 13.

By using the imprinting fabric on the top of the sheet, and the anti-rewet fabric on the bottom of the sheet, rewet is greatly decreased, so that a 25 GSM tissue sheet now has solids close to the values predicted by the Sweet plot.

From the above discussion, it can be seen that one aspect of the present invention is the order and type of fabrics used in the displacement pressing process. One object of the present invention is to reach the highest sheet solids possible, at the lowest cost and without greatly affecting the bulk of the sheet. The fabric positions and types are one part of attaining this goal. By putting the imprinting fabric on the top of the sheet, and the anti-rewet layer underneath, high solids can be reached through mechanical removal of water. To create the mechanical pressure and limit the air flow a membrane with a low permeability is used. The permeability is e.g. less than 15 cfm, preferably less than 10 cfm, and preferably less than 8 cfm, measured by TAPPI test method TIP 0404-20. In addition it is advantageous to operate the air press for displacement dewatering with a pressure in the chamber of >30 psi, preferably >40 psi.

Figure 14:
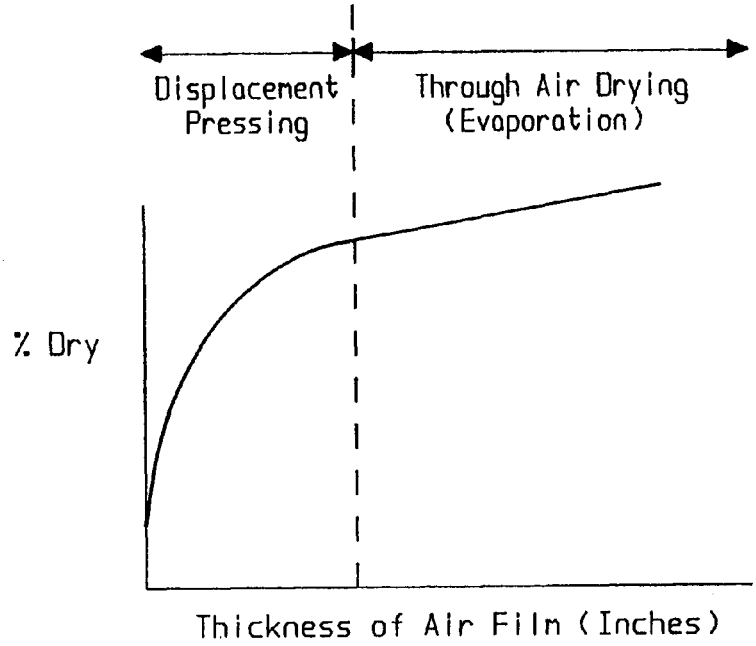

Mechanical removal of water is much cheaper than evaporative drying, so an object of the present invention is to reach the highest solids possible without evaporative drying. It was found that the amount of air that is passed through the sheet is best measured as a film thickness of atmospheric air. As the film thickness of air pushed through the sheet increases, the water removal process progresses. The more air pushed through the sheet, the dryer the sheet becomes. This behavior for the displacement pressing process is shown in FIG. 14. From this plot, we can see that initially, a thin air film will remove a lot of water. But as the dryness of the sheet increases, it takes more and more air to remove water from the sheet.

Figure 15:
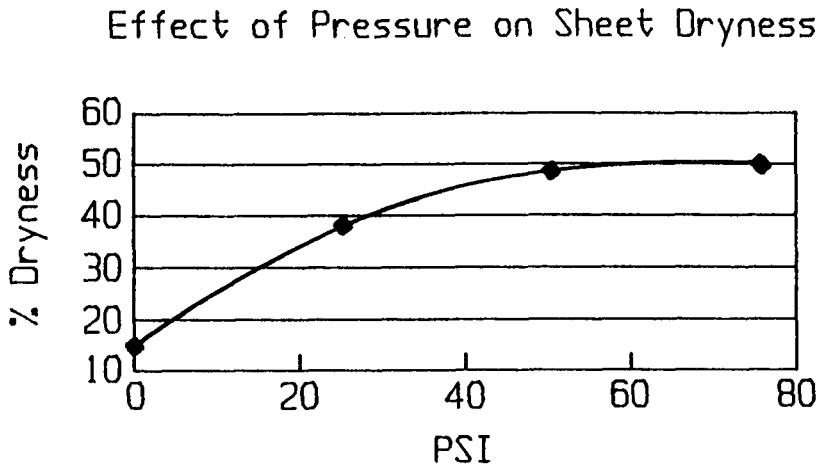

There are two fundamentally different dewatering mechanisms taking place. The first mechanism is the displacement pressing phase. During this phase, water primarily leaves the sheet as a liquid. The water moves out of the sheet and into the anti-rewet layer and/or the vented roll. In general, it takes less than 5" and generally 5" or less of air film (thickness) to remove water in the displacement pressing phase. To increase sheet dryness in the displacement pressing phase, air pressure should be increased. Increasing air pressure increases mechanical pressure, which increases the ultimate dryness attainable by the process. There are limits to this as is seen in FIG. 15. From this graph it is obvious that vacuum dewatering (which is a low pressure process) as is being done currently by most TAD processes, will only give low dryness sheets. If the objective is to remove the most water in the displacement pressing phase, it's important to use pressure that is high enough for the paper being dewatered.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

REFERENCE LIST

10—Apparatus
12—Fiber Web
14—Imprinting Fabric
16—Suction element
18—Press nip
20—Dryer Cylinder
20'—Yankee Cylinder
22—Opposing element, Shoe Press Unit
24—Press Shoe
26—Flexible Sleeve, Flexible Roll Sleeve
29—Turning Roll
30—Suction Device, Suction Roll
34—Dewatering Apparatus with Capillary Action or Anti-Rewetting Membrane
36—Felt with Foamed Layer, SPECTRA Membrane or anti-rewetting membrane
38—Large Suction Roll
40—Vacuum Box
42—Dewatering Fabric
44—Pulp run in gap
46—Forming Element, Forming Roll
48—Head Box
50—Pick-up Element or Separation Element
52—Dryer Hood
54—Inner Dewatering Fabric
56—Air Press
58—Pressure Space
60—Roll
62—Roll
64—Roll
66—Roll
68—Raised Zone
70—Pressing Zone
72—Air Distribution Membrane
74—Holes
76—Conventional Fabric
78—Inner Fabric
80—Cleaning Device
82—U-Shaped Box
84—Air Flow d, Thickness L, web running direction, first pressure field, further pressure field.

What is claimed is:

1. A method for manufacturing a fiber web having a three-dimensional surface structure, comprising:

pressing the fiber web at a dry content of less than approximately 35% onto an imprinting fabric by a suction element arranged on a surface of the imprinting fabric remote from the fiber web to produce a first pressure field to suck the fiber web into a surface structure of the imprinting fabric to dewater the fiber web in a first direction;

guiding the fiber web through at least one other pressure field against a drying cylinder to at least one of dewater and dry the fiber web; and guiding a clothing, the imprinting fabric, and the fiber web located between the clothing and the imprinting fabric over a dewatering arrangement having at least one roll, such that the clothing is in contact with the at least one roll and the dewatering occurs in a direction opposite the first direction.

2. The method of claim 1, wherein said dry content is less than 30%.

3. The method of claim 2, wherein said dry content is less than 25%.

4. The method of claim 1, wherein the at least one further pressure field comprises a second pressing of the fiber web onto an other imprinting fabric by way of a second pressure field, thereby fixing the strength of the fiber web without destroying the three-dimensional surface, and the at least one roll of the at least one dewatering arrangement being a suction roll arranged to produce at least one third pressure field.

5. The method of claim 4, wherein said second pressure field is produced by way of a press nip.

6. The method of claim 5, wherein said press nip forming said second pressure field is produced between a dryer cylinder and an opposing element, with the fiber web being guided through said press nip, one side of the fiber web being in contact with a surface of said dryer cylinder and an other side of the fiber web contacting said imprinting fabric.

7. The method of claim 6, wherein said dryer cylinder is a Yankee cylinder.

8. The method of claim 6, wherein said opposing element is a shoe press unit that interacts with said dryer cylinder, said shoe press unit including a flexible sleeve guided via a press shoe in a region of said press nip.

9. The method of claim 8, wherein said press nip associated with said shoe press and said dryer cylinder, has a length observed in the web running direction, said length being larger than approximately 80 mm, said shoe press having a pressure profile over said length of said press nip with a maximum pressing pressure which is smaller than or equal to approximately 2.5 MPa.

10. The method of claim 6, wherein said opposing element is a shoe press unit including a shoe pressing roll provided with a flexible roll sleeve.

11. The method of claim 6, wherein said opposing element is one of a pressing roll and a suction pressing roll interacting with said dryer cylinder.

12. The method of claim 6, wherein said fiber web is pre-imprinted and is dried on the dryer cylinder, the fiber web being at least one of creped and wound up.

13. The method of claim 4, wherein said second pressing includes the step of gently pressing the fiber web in said second pressure field over an extended nip in a web running direction.

14. The method of claim 4, wherein the fiber web is guided between said first pressure field and said second pressure field, and through said at least one third pressure field.

15. The method of claim 4, wherein said imprinting fabric and said other imprinting fabric are the same imprinting fabric being used in said first pressure field and in said second pressure field.

16. The method of claim 4, wherein said third pressure field is located between said first pressure field and said second pressure field in a running direction of the fiber web.

17. The method of claim 4, wherein a drying apparatus composed of the at least one roll is used to provide said third pressure field.

18. The method of claim 17, wherein said drying device further includes a pressurized hood to support a vacuum effect of said suction device.

19. The method of claim 4, wherein the fiber web is guided together with said imprinting fabric both through said third pressure field and said second pressure field.

20. The method of claim 4, wherein said at least one roll being a suction roll that forms part of a gas press.

21. The method of claim 20, wherein said gas press is an air press.

22. The method of claim 20, wherein said gas press includes an arrangement of at least four rolls.

23. The method of claim 22, further comprising the step of providing a twin wire former with two circulating dewatering fabrics which run together, thereby forming a pulp run-in gap, said dewatering fabrics being guided over a forming element, at least one of said two dewatering fabrics having a zonally different fabric permeability used as one of an inner fabric and an outer fabric, said outer fabric not coming into contact with said forming element.

24. The method of claim 23, wherein said forming element is a forming roll.

25. The method of claim 23, wherein said inner fabric is an imprinting fabric, said outer fabric being a dewatering fabric with zonally different fabric permeability.

26. The method of claim 25, further comprising the step of transferring the fiber web from said inner fabric to an imprinting fabric.

27. The method of claim 20, wherein said gas press includes a U-shaped box.

28. The method of claim 20, wherein said gas press includes a chamber operated with a pressure therein of at least approximately 30 psi.

29. The method of claim 28, wherein said pressure is at least 40 psi.

30. The method of claim 1, wherein said imprinting fabric is one of a woven fabric and a casted fabric in a continuous loop.

31. The method of claim 1, wherein said imprinting fabric is one of a TAD (through-air-drying) fabric or an imprinting membrane.

32. The method of claim 1, further comprising pre-imprinting the fiber web downstream of a forming region.

33. The method of claim 1, further comprising forming the fiber web on said imprinting fabric.

34. The method of claim 1, further comprising transferring the fiber web onto said imprinting fabric, said imprinting fabric being used for pre-imprinting the fiber web.

35. The method of claim 1, wherein said imprinting fabric is used for pre-imprinting and for fixing strength of the fiber web.

36. The method of claim 1, wherein at least said first pressure field is further produced by a pressure element being arranged to press the fiber web into a surface structure of said imprinting fabric.

37. The method of claim 36, wherein said suction element is a wet suction box, and said pressure element is a pressure box.

38. The method of claim 1, wherein said dry content at which at least one of the fiber web being pre-imprinted and the three-dimensional surface structure being created is less than approximately 30%.

39. The method of claim 38, wherein said dry content is less than 25%.

40. The method of claim 39, wherein said dry content is less than 15%.

41. The method of claim 40, wherein said dry content is less than 10%.

42. The method of claim 1, further comprising-forming the fiber web in a forming region on at least one dewatering fabric with a zonally different fabric permeability.

43. The method of claim 1, further comprising guiding said imprinting fabric through a press nip, said imprinting fabric having a smaller contact area portion formed by one of raised and closed zones than a non-contact area portion formed by one of recessed zones and holes, thereby a correspondingly smaller contact area portion of the fiber web is pressed in the press nip.

44. The method of claim 43, wherein said imprinting fabric is one of a TAD fabric and an imprinting membrane.

45. The method of claim 43, wherein said imprinting fabric has a contact area proportion of said raised and closed zones of less than approximately 40%.

46. The method of claim 45, wherein said contact area proportion lies in a range from approximately 20% to 30%.

47. The method of claim 46, wherein said contact area proportion lies in a range from approximately 20% to 25%.

48. The method of claim 43, wherein said raised zones and said recessed zones result from offsets of said imprinting fabric.

49. The method of claim 48, wherein said offsets are intersection points of picks and ends of said imprinting fabric.

50. The method of claim 1, wherein the at least one roll being a suction roll that produces the at least one other pressure field to dewater the fiber web, and the clothing comprises at least one felt with a foamed layer.

51. The method of claim 50, wherein said foamed layer includes a plurality of pores having a mean pore size from approximately 3 μm to 6 μm.

52. The method of claim 1, wherein the at least one roll being a suction roll that produces the at least one other pressure field to dewater the fiber web, and the clothing comprises an anti-rewetting membrane.

53. The method of claim 52, wherein said dewatering further includes using a woven fabric along with said anti-rewetting membrane.

54. The method of claim 1, wherein when said at least one roll comprises one suction roll, said one suction roll has a diameter from approximately 2 m to 3 m, and when said at least one suction roll comprises a plurality of suction rolls, said plurality of suction rolls have diameters of approximately 2 m.

55. The method of claim 54, wherein said plurality of suction rolls is two suction rolls.

56. The method of claim 54, further comprising applying a vacuum to a lower side of said suction roll.

57. The method of claim 1, further comprising applying a vacuum to a journal of said at least one suction roll.

58. The method of claim 1, wherein the at least one roll being a suction roll that produces the at least one other pressure field to dewater the fiber web, and said dewatering uses one of said roll having an associated siphon extractor and spinning water from the fiber web into a channel by centrifugal force.

59. The method of claim 58, further comprising blowing off said water by way of an air knife.

60. The method of claim 1, wherein the at least one roll being a suction roll that forms, in combination with at least three additional rolls, a pressure space containing the at least one other pressure field, and the method further comprises driving water out of the fiber web by way of a gas under pressure in the pressure space, the fiber web being guided together with the imprinting fabric at least once through the pressure space, into which said gas is fed.

61. The method of claim 60, wherein said gas is air.

62. The method of claim 1, wherein the clothing is one of a fabric, a felt, a felt with a foamed layer, a SPECTRA membrane with a conventional woven fabric, an anti-rewetting membrane with a conventional woven fabric, and an anti-rewetting membrane without a conventional woven fabric.

63. A method for manufacturing a fiber web having a three-dimensional surface structure, comprising:

pressing the fiber web at a dry content of less than approximately 35% onto an imprinting fabric by a suction element arranged on a surface of the imprinting fabric remote from the fiber web to produce a first pressure field to suck the fiber web into a surface structure of the imprinting fabric, thereby imprinting the web;

guiding the fiber web through at least one other pressure field to at least one of dewater and dry the fiber web; and guiding a clothing, the imprinting fabric, and the fiber web located between the clothing and the imprinting fabric over at least one suction roll, such that the clothing is in contact with the at least one suction roll, wherein the at least one suction roll produces the at least one other pressure field to dewater the fiber web, and the clothing comprises a SPECTRA membrane attached to an air distribution layer, said SPECTRA membrane being used with a conventional woven fabric, said woven fabric arranged between said SPECTRA membrane and a through flow cylinder.

64. The method of claim 63, wherein said SPECTRA membrane is laminated to said air distribution layer.

65. A method for manufacturing a fiber web having a three-dimensional surface structure, comprising:

pressing the fiber web at a dry content of less than approximately 35% onto an imprinting fabric by a suction element arranged on a surface of the imprinting fabric remote from the fiber web to produce a first pressure field to suck the fiber web into a surface structure of the imprinting fabric, thereby imprinting the web;

guiding the fiber web through at least one other pressure field to at least one of dewater and dry the fiber web; and guiding a clothing, the imprinting fabric, and the fiber web located between the clothing and the imprinting fabric over at least one suction roll, such that the clothing is in contact with the at least one suction roll, wherein said dewatering further includes using a woven fabric along with said anti-rewetting membrane, and wherein said anti-rewetting membrane is used without an additional fabric.

66. A method for manufacturing a fiber web having a three-dimensional surface structure, comprising:

pressing the fiber web at a dry content of less than approximately 35% onto an imprinting fabric by a suction element arranged on a surface of the imprinting fabric remote from the fiber web to produce a first pressure field to suck the fiber web into a surface structure of the imprinting fabric, thereby imprinting the web;

guiding the fiber web through at least one other pressure field to at least one of dewater and dry the fiber web; and guiding a clothing, the imprinting fabric, and the fiber web located between the clothing and the imprinting fabric over at least one suction roll, such that the clothing is in contact with the at least one suction roll, wherein the at least one suction roll forms, in combination with at least three additional rolls, a pressure space containing the at least one other pressure field, and the method further comprises driving water out of the fiber web by way of a gas under pressure in the pressure space, the fiber web being guided together with the imprinting fabric at least once through the pressure space, into which said gas is fed, and further comprising guiding the fiber web with said imprinting fabric between said clothing and at least one additional membrane through said pressure space, said clothing and said at least one additional membrane including at least one of an air distribution membrane and an anti-rewetting membrane.

67. The method of claim 66, wherein each of said at least two membranes have a thickness of approximately 1 mm to 3 mm.

68. A method for manufacturing a fiber web having a three-dimensional surface structure, comprising:

suctioning the fiber web at a dry content of less than approximately 35% onto an imprinting fabric by a suction element arranged on a surface of the imprinting fabric remote from the fiber web to produce a first pressure field to suck the fiber web into a surface structure of the imprinting fabric to dewater the fiber web in a first direction;

guiding the fiber web through at least one other pressure field directed against a drying cylinder to at least one of dewater and dry the fiber web; and guiding a clothing, the imprinting fabric, and the fiber web located between the clothing and the imprinting fabric over at least one alternate drying apparatus comprising a counter device comprising an open surface, wherein the clothing contacts the open surface of the counter device and the dewatering occurs in a direction opposite the first direction.

69. The method in accordance with claim 68, wherein the counter device comprises one of a vented roll and an open box with a slotted or drilled cover.

70. The method of claim 68, wherein said at least one alternate drying apparatus comprises a gas press.

71. The method of claim 70, wherein said gas press is an air press.

72. The method of claim 70, wherein said gas press includes an arrangement of at least four rolls.

73. The method of claim 70, wherein said gas press includes a U-shaped box.

* * * * *